United States Patent [19]

Peck

[11] Patent Number: 4,881,516

[45] Date of Patent: Nov. 21, 1989

[54] ADJUSTABLE GRIP AND TRIGGER BOW STRING RELEASE

[75] Inventor: Paul L. Peck, Fond du Lac, Wis.

[73] Assignee: Archery Designs, Inc., North Fond du Lac, Wis.

[21] Appl. No.: 194,221

[22] Filed: May 16, 1988

[51] Int. Cl.[4] ..... F41C 19/00

[52] U.S. Cl. ..... 124/35 A

[58] Field of Search ..... 124/35 A, 35 R, 31

[56] References Cited

U.S. PATENT DOCUMENTS

| | | | |
|---|---|---|---|
| 2,488,597 | 11/1949 | Konold | 124/35 A |
| 3,845,752 | 11/1974 | Barner | 124/35 A |
| 4,062,339 | 12/1977 | Wilson | 124/35 A |
| 4,249,507 | 2/1981 | Marra | 124/35 A |
| 4,257,386 | 3/1981 | Gazzara | 124/35 A |
| 4,316,443 | 2/1982 | Giacomo | 124/35 A |
| 4,485,798 | 12/1984 | Hamm | 124/35 A |
| 4,603,676 | 8/1986 | Luoma | 124/35 A X |
| 4,620,523 | 11/1986 | Peck | 124/35 A |

*Primary Examiner*—Peter M. Cuomo
*Attorney, Agent, or Firm*—Bayard H. Michael

[57] ABSTRACT

The bow string release has a body with a string receiving notch in one end of the body and an axial hole through the other end of the body. A sear is pivoted adjacent the notch and is operative to retain a bow string in the notch. The handle has an axial hole therethrough. A guide sleeve is connected to the body and extends through the axial holes in the body and handle. An enlargement on the other end of the guide sleeve captures the handle relative to the guide sleeve. A spring acting between the guide sleeve and the handle takes up dimensional variations. A pull pin is slidably mounted in the guide sleeve for movement between a first position in which it engages the sear and a retracted position releasing the sear. A spring biases the pin to its first position. A trigger carried by the handle is operative to move the pin to its retracted position. Both the handle and the body are rotatable relative to each other and relative to the pin. An adjusting screw adjusts the axial position of the pull pin relative to the sear.

6 Claims, 1 Drawing Sheet

ADJUSTABLE GRIP AND TRIGGER BOW STRING RELEASE

BACKGROUND OF THE INVENTION

Bow string releases have grown in popularity for target shooting and for hunting. A good release provides uniform "let-off" which increases accuracy. A release should provide for adjustment of the trigger stroke and should allow adjustment of the relative angular relationship between the handle and the bow string. A common failing in the art is that adjustmens are interdependent in that adjusting one affects the other. Similarly, tolerance build-up can adversely affect repeatable performance.

The object of this invention is to provide a release having such independent adjustment of the trigger stroke and angular relationship between the bow string and handle while also automatically compensating for tolerance build-up.

This invention is an improvement on the structure shown in my Pat. No. 4,620,523 in which tolerance build up affected adjustment and adjustment after assembly was troublesome.

SUMMARY OF THE INVENTION

This invention provides a bow string release in which the body has a string receiving notch in one end and an axial hole through the other end. A sear is pivoted in the body adjacentn the notch and has a string retaining finger operative to retain a bow string in the notch when the sear is in its operative position. The release includes a handle having an axial hole therethrough. A guide sleeve extends through the axial holes in the handles and threads into the axial hole in the body so an enlargement on the other end of the guide assembly captures the handle on the guide. The body is rotatable relative to the handle. A pull pin assembly is rotatably and slidably mounted in the guide sleeve for movement between a first position and a retracted position. An enlarged head on one end of the pin assembly engages the sear in said first position to retain the sear in operative position. The pin releases the sear upon movement to retracted position. A spring biases the pin to the first position. A trigger is carried by the handle and is operative to move the pin to the retracted position. The handle and body are rotatable relative to each other and relative to the pin assembly. A wavy washer spring (a Belleville spring) acts on the other end of the guide sleeve to thereby seat the other enlarged head against the handle. All tolerance in the axial direction is taken up in the spring. Only two parts now need to be concentric while prior releases used three concentric parts which can be trouble.

The trigger stroke can be adjusted without affecting any other adjustments and vice versa.

DETAILED DESCRIPTION OF THE DRAWINGS

Figure 1:
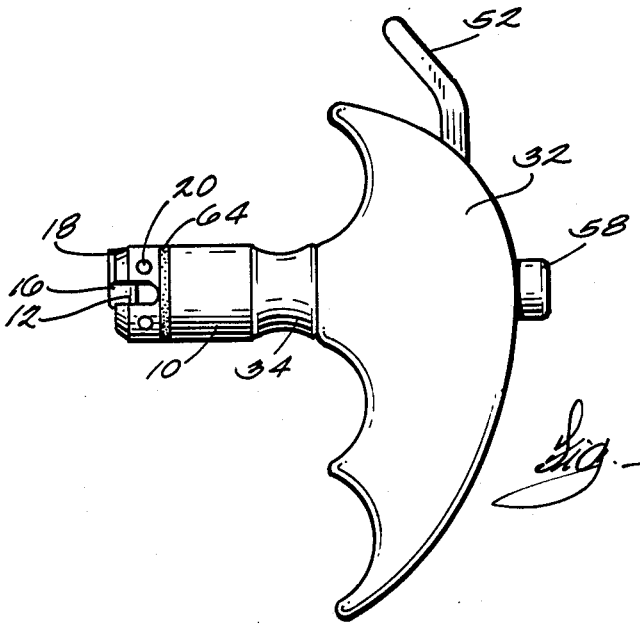
FIG. 1 is an elevation of a release which incorporates this invention.
Figure 3:
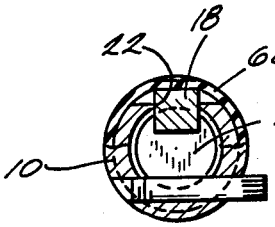
FIG. 3 is a section taken on line 3—3 of FIG. 2.

The release shown has a body of barrel 10 having diametrically opposed slots 12 to receive bow string 14 for retention by retaining finger 16 projecting at right angles from sear 18 pivoted in the barrel on roll pin 20 adjacent slot 22 which permits the sear freedom of pivotal movement relative to the body. The sear is also provided with a projecting reset button 24 against which the bow string can be pushed to move the sear counter-clockwise to permit the round end 25 of the spring loaded plunger or pull pin 26 to slide inside and under the right end of the sear 18 to retain it in its cocked position. As the release is moved to draw the bow string, the bow string will act against the retaining finger 16 trying to move the pin in a clockwise direction, but the sear is prevented from such movement by its engagement with the pull pin 26.

Pull pin 26 is slidably mounted in guide 28 which extends through holes i nhandle 32 and spool 34 to thread into hole 30 in the barrel 10. The enlarged head 36 on the guide 28 is spaced from the wall 38 in the slot 40 in the handle when the guide 28 is threaded into the barrel with the spool 34 between the handle and the barrel. The space between the head 36 and wall 38 is taken up by Belleville spring 42 between two flat washers 44, 46 so as to draw spool 34 against the handle just as the barrel is drawn against the spool. The guide threads into body 10 until it bears against internal shoulder 29 which positively and accurately determines the space between head 36 and wall 38 which receives the Belleville spring 42 and washers 44, 46. This ensures adequate space to take up tolerance variations (up to ±0.04" which is a lot). Alternatively, the guide sleeve can be provided with a shoulder adjacent the threads to engage the body around the hole. It will be appreciated that any tolerance variations in the barrel, the spool and the handle and in the guide 28 will be taken up by the Belleville spring.

Figure 2:
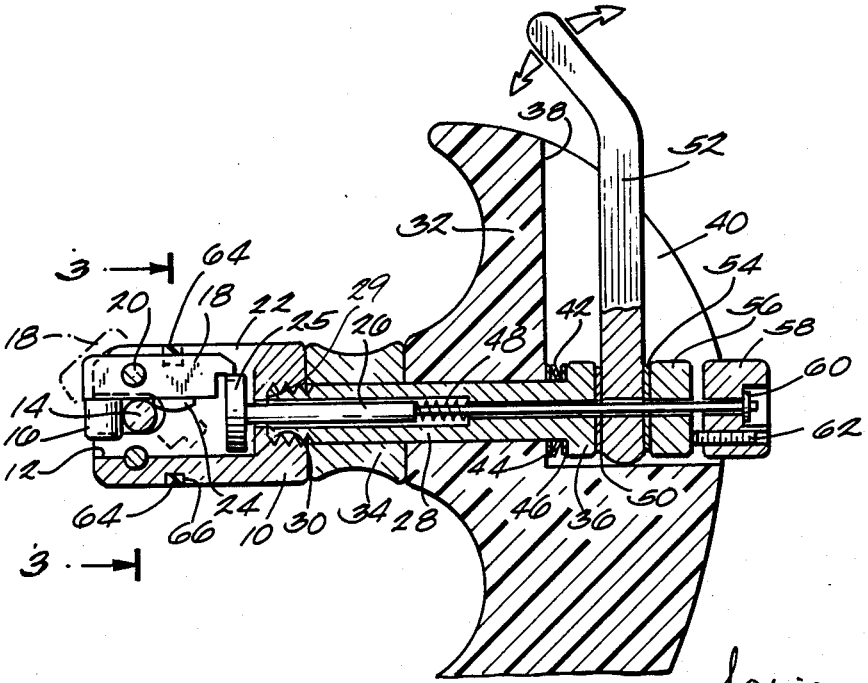
FIG. 2 is a vertical section through the release.

Pull pin 26 is mounted in the guide 28 with a coil spring 48 bearing against an internal shoulder in the guide and against the enlarged section of the pull pin to bias the pin to the left in FIG. 2. The right end of the pull pin 26 passes throughw sher 50, a hole in trigger 52, washer 54, spacer 56 and head 58. A C-ring retainer 60 is mounted on the right end of the pull pin and seats in the recess in head 58. Adjusting screw 62 threaded into head 58 bears against spacer 56 to adjust the position of the pull pin relative to the sear 18. Since everything is "solid" with the Belleville spring 42 taking up the slack or tolerance in the system, the adjusting screw 62 can precisely adjust the position of pull pin head 25 relative to the tip of the sear and thereby adjust the degree of overlap of the sear on the head. This in turn reflects in the length of stroke in either direction (as dipicted by the arrows in FIG. 2) necessary to release the sear and cause release of the bow string.

With this type of adjustment, the trigger action can be extremely sensitive and is immune from variations in the dimensions of the spool, the handle, the barrel, the pull pin and the like. All variations are accommodated in the Belleville spring. The barrel can rotate with and with respect to the spool and relative to the handdle as well. Thus, the disposition of the handle relative to the bow string is completely adjustable to give the archer the most comfortable grip for his shooting style.

The use of the flat washers 44, 46 on either side of the Belleville spring 42 minimizes spring wear as a handle rotates. The characteristics of the Belleville spring will remain more uniform.

When the sear is engaged and retained by the enlarged head 25 of the pull pin 26, the rubber ring 64, which encircles the barrel and is received in the groove 66 in the barrel, engages the sear as may be seen in the drawing. Thus, the rubber ring biases the sear in the opening direction to release the bow string when the pull pin is pulled. The force on the bow string however is more than adequate to open the release. The important aspect of the rubber ring 64, however, is that when the release is open, the rubber ring spans the slot 22 and keeps the release open. Therefore, when the archer wishes to use the release, he simply pushes the open release over the string and lets the string act against the button 24 to swing the release counter-clockwise until it engages and is retained by pull pin head 25. Thus, mounting the release on the bow string is a one hand operation and is very quickly accomplished. Without the rubber band, the archer would have to manually hold the release out of the way to let the bow string get into the string notch 12.

I claim:

1. A bow string release comprising, a body having a string receiving notch in one end of said body and an axial hole through the other end of said body, a sear pivoted in the body adjacent said notch and having string retaining means operative to retain a bow string in said notch when said sear is in its operative position, handle means having an axial hole therethrough, an internal shoulder in said axial hole in said body, guide means comprising a guide sleeve having one end threaded into said axial hole of said body and extending through said axial holes, an enlargement on the other end of said guide sleeve capturing said handle means relative to said guide sleeve, said guide sleeve bearing against said shoulder to fix the location of said enlargement relative to said body, a Belleville spring effective between said other end of said guide sleeve and said handle means to take up dimensional variations, pull pin means slideably mounted in said guide sleeve for movement between a first position and a retracted position, said pull pin means engaging said sear in said first position to retain said sear in said operative position and releasing said sear upon movement to said retracted position, spring means biasing said pull pin means to said first position, a trigger carried by said handle means and operative to move said pull pin means to said retracted position, means adjusting the axial position of said pull pin means relative to said sear to adjust the release stroke of said pull pin means, said guide sleeve being non-rotatable relative to said body during use of the release and during adjustment of the release, said handle means and said body being rotatable relative to each other and relative to said pull pin means and the release stroke of said pull pin means remaining constant during rotation of said handle means and said body relative to each other and relative to said pull pin means.

2. A bow string release according to claim 1 which said pull pin means is rotatable with respect to said sear and said guide sleeve.

3. A bow string release according to claim 2 including a spool rotatably mounted on said guide sleeve between said handle means and said body.

4. A bow string release according to claim 1 in which said axial position adjusting means comprises means acting to limit movement of said pull pin means in the direction of said first position.

5. A bow string release according to claim 1 in which said trigger is actuated in a plane including the axis of said axial holes, said trigger and said handle being rotatable relative to said body.

6. A bow string release according to claim 1 in which said internal shoulder is engaged by said guide sleeve as it is threaded into said axial hole in said body to determine the position of said sleeve relative to said body.

* * * * *